US005608179A

United States Patent [19]

Voecks et al.

[11] Patent Number: 5,608,179

[45] Date of Patent: Mar. 4, 1997

[54] CATALYTIC IGNITOR FOR REGENERATIVE PROPELLANT GUN

[75] Inventors: Gerald E. Voecks, La Crescenta; Ned W. Ferraro, Long Beach, both of Calif.

[73] Assignee: The United States of America as represented by the Administration of the National Aeronautics and Space Administration, Washington, D.C.

[21] Appl. No.: 200,785

[22] Filed: Feb. 18, 1994

[51] Int. Cl.[6] ..... F41F 1/00

[52] U.S. Cl. ..... 89/7; 89/7

[58] Field of Search ..... 89/7, 8

[56] References Cited

U.S. PATENT DOCUMENTS

| | | | |
|---|---|---|---|
| 3,943,705 | 3/1976 | DeCorso et al. | 60/39 |
| 4,085,653 | 4/1978 | Tassie et al. | 89/7 |
| 4,745,841 | 5/1988 | Magoon et al. | 89/7 |
| 4,838,142 | 6/1989 | Birk | 89/7 |
| 4,930,394 | 6/1990 | Zwingel et al. | 89/7 |
| 4,936,188 | 6/1990 | Puckett | 89/7 |
| 4,938,112 | 7/1990 | Hertzberg et al. | 89/7 |

*Primary Examiner*—Michael J. Carone
*Attorney, Agent, or Firm*—Thomas H. Jones

[57] ABSTRACT

An ignitor initiates combustion of liquid propellant in a gun by utilizing a heated catalyst onto which the liquid propellant is sprayed in a manner which mitigates the occurrence of undesirable combustion chamber oscillations. The heater heats the catalyst sufficiently to provide the activation necessary to initiate combustion of the liquid propellant sprayed thereonto. Two embodiments of the ignitor and three alternative mountings thereof within the combustion chamber are disclosed. The ignitor may also be utilized to dispose of contaminated, excess, or waste liquid propellant in a safe, controlled, simple, and reliable manner.

20 Claims, 2 Drawing Sheets

CATALYTIC IGNITOR FOR REGENERATIVE PROPELLANT GUN

ORIGIN OF INVENTION

The invention described herein was made in the performance of work under a NASA contract, and is subject to the provisions of Public Law 96-517 (35 U.S.C. 202) in which the contractor has elected not to retain title.

TECHNICAL FIELD

The present invention relates generally to weaponry and more particularly to an ignitor for initiating combustion of liquid propellant in a regenerative propellant gun, wherein the liquid propellant is sprayed upon, and passed through, a heated catalyst bed in a manner which facilitates smooth combustion of the liquid propellant and thus mitigates undesirable combustion chamber oscillations.

BACKGROUND ART

Regenerative propellant guns wherein a liquid propellant is pumped into a combustion chamber and ignited so as to propel a projectile from the barrel of the gun are known. Such contemporary regenerative liquid propellant guns typically comprise a variable volume combustion chamber wherein inner and outer concentric pistons cooperate to pump and meter additional liquid propellant into the combustion chamber as the combustion process proceeds. Liquid propellant disposed within a reservoir formed between the inner and outer pistons is forced out of the reservoir as the inner and outer pistons are moved in a combustion chamber volume increasing direction as a result of the combustion process.

The liquid propellant is forced through an annular opening formed between the inner and outer pistons as the inner and outer pistons travel in the combustion chamber volume increasing direction. The flow of liquid propellant from the reservoir is metered into the combustion chamber by the annular orifice whose area depends upon the relative positions of the inner and outer pistons.

The ignition of liquid propellant within contemporary regenerative liquid propellant guns is typically performed as a four step process. In the first step, a mail box or primer charge is ignited at the distal end of an ignition tube connected to the combustion chamber. In the second step, the primer charge ignites a larger intermediate quantity of liquid explosive disposed within the tube at a position closer to the combustion chamber. In the third step, the intermediate charge ignites a puddle charge disposed within the combustion chamber. In the fourth step, the puddle charge ignites the main charge so as to initiate regenerative combustion of liquid propellant sprayed from the reservoir into the combustion chamber of the gun. As such, the initiation of the main charge involves an undesirably complex and unreliable series of separate steps.

Prior to ignition of the puddle charge disposed within the combustion chamber, the inner and outer pistons are in a minimum combustion chamber volume position wherein the inner and outer pistons cooperate to close the annular orifice defined therebetween and thus prevent the flow of liquid propellant from the reservoir into the combustion chamber.

Upon ignition of the puddle charge, increased pressure within the combustion chamber urges the inner and outer pistons in a combustion chamber volume increasing direction. Typically, the inner piston, having a greater surface area than the outer piston, is urged in the combustion chamber volume increasing direction at a slightly faster rate than the outer piston. Thus, such relative motion of the inner and outer pistons causes them to separate and open the annular orifice to the liquid petroleum reservoir. Movement of the inner and outer pistons reduces the volume of the liquid propellant reservoir, thus forcing liquid propellant from the liquid propellant reservoir into the combustion chamber at a rate determined by the movement of the inner and outer pistons and the area of the annular orifice formed therebetween. Such pumping of the liquid propellant from the reservoir into the combustion chamber by the inner and outer pistons facilitates the regenerative combustion process so as to accelerate a projectile through the barrel of the gun.

Such regenerative guns commonly utilize a liquid propellant comprising a concentrated aqueous nitrate salt solution. Such concentrated aqueous nitrate salt solutions are substantially viscous and dense. They require an elevated temperature and pressure in order to sustain continuity in the combustion reaction.

The aqueous nitrate salt solutions commonly utilized in regenerative propellant gun applications typically comprise hydroxylammonium nitrate (HAN) and triethanolammonium nitrate (TEAN). It has been suggested that combustion of the HAN and TEAN involves a first reaction wherein the decomposition of HAN releases hydroxyl radicals and heat so as to produce an increase in pressure within the combustion chamber, followed by a subsequent reaction involving the rapid chemical reaction of the TEAN.

The ignition of such premixed fuel/oxidant liquid propellants is commonly initiated in contemporary regenerative propellant guns by electrical arcs, explosives and lasers, for example, which provide the conditions necessary to sustain completion of the subsequent chemical reactions. However, the heat initially generated by such contemporary ignitors is rapidly absorbed by the water component of the aqueous nitrate salt solution, thus generating steam. A substantial quantity of the energy provided by such contemporary ignitors is thus undesirably utilized in converting the water of the aqueous nitrate salt solution into steam, thereby increasing the quantity of energy which must be provided by the ignitor in order to heat and ignite the liquid propellant.

The puddle charge utilized in contemporary regenerative guns inherently has a limited surface area available for atomization and reaction, further increasing the quantity of energy required to be provided by the ignitor. Such puddle charges of liquid propellant inherently result in slow and very directional combustion reactions.

Because the energy requirements for reliable ignition of the liquid propellant in contemporary regenerative propellant guns is substantial, the use of electrical energy, i.e., electrical arcs, lasers, etc., is not convenient for battlefield applications.

Furthermore, it is difficult to attain reliable and consistent ignition of liquid propellants in such contemporary regenerative propellant guns. Reliability and consistency of ignition of the liquid propellants used in contemporary regenerative propellant guns is reduced due to the high energy requirement for such ignition and the low surface area associated with the puddle charge used therein.

Such inconsistency in the ignition process is thought to contribute to the generation of undesirable combustion oscillations which occur as additional liquid propellant is sprayed into the combustion chamber during the regenerative process. Such combustion chamber oscillations inhibit precise control of the combustion process which is required for accurate operation of the regenerative propellant gun. As such, it is desirable to provide a means for attaining reliable and consistent ignition of liquid propellants in regenerative propellant guns so as to mitigate the occurrence of undesirable combustion chamber oscillations.

Furthermore, the above-mentioned difficulties in initiating combustion of such liquid propellants present an additional concern regarding the safe disposal of contaminated, excess, or waste liquid propellant. The disposal of such contaminated, excess, or waste liquid propellant causes substantial environmental concern.

Thus, an alternative method for igniting liquid propellant which is safe, controlled, simple, and reliable is desirable from a military, as well as an environmental point of view.

STATEMENT OF THE INVENTION

The present invention specifically addresses and alleviates the above-mentioned deficiencies associated with the prior art. More particularly, the present invention comprises an ignitor for initiating combustion of a liquid propellant in a regenerative propellant gun. The ignitor comprises a catalyst onto which a liquid propellant, such as a mixture of HAN and TEAN, is sprayed and a heater for heating the catalyst. The heater heats the catalyst sufficiently to provide the activation energy necessary to initiate combustion of the liquid propellant sprayed thereonto.

The catalyst is preferably generally comprised of a transition element, preferably a noble metal such as platinum, palladium, rhodium, iridium, ruthenium, and osmium, or an alloy thereof. Those skilled in the art will recognize that various other materials are likewise suitable.

The catalyst is formed upon a substrate which defines an electrical resistance heater. The substrate preferably comprises a high temperature alloy such as KANTHAL. A wash coat or layer of a porous material, such as alumina, is preferably disposed onto the substrate, into which the catalyst is dispersed, so as to increase the exposed surface area of the catalyst and thus substantially increase the reaction surface thereof.

Preferably, the substrate is formed of corrugated planar material which is spirally rolled into a tube through which the liquid propellant is sprayed. A non-corrugated planar sheet of the same material may optionally be disposed between the adjacent rolled layers of the corrugated material to prevent the corrugations of adjacent layers from fitting into one another. The non-corrugated sheet thereby maintains proper spacing of adjacent corrugated layers. Preferably, both the corrugated material and the non-corrugated material are coated with alumina or the like and catalyst.

Alternatively, concentric tubular sections of corrugated substrate may be utilized, preferably separated by non-corrugated sections of substrate material. Again, both the corrugated and non-corrugated sections are preferably coated with alumina or the like and catalyst. Those skilled in the art will recognize that various other configurations of the substrate and catalyst are likewise suitable. Corrugations, or other designs to enhance mixing of reactants, may be configured in such a way as to produce tortuous paths of flow. Apertures are optionally formed in the substrate to further provide or enhance a tortuous path. The arrangement of the rolled layers may also be configured in shapes other than cylinders, e.g., cones.

The liquid propellant is sprayed through the ignitor of the present invention so as to initiate and sustain combustion thereof within the combustion chamber of a regenerative propellant gun in a manner which mitigates the occurrence of undesirable combustion chamber oscillations.

In use, liquid propellant is atomized and/or sprayed through the ignitor, thereby coming into contact with the catalyst formed upon the corrugated surface of the substrate and the surface of the separating layers. Electric current, preferably DC, flowing through the substrate heats the catalyst to a temperature such that sufficient activation energy is provided to initiate combustion of the liquid propellant. The hot effluent of liquid propellant sprayed through the ignitor is directed into the combustion chamber of the regenerative liquid propellant gun.

The use of such a catalyst provides a uniform site and surface at which ignition occurs. The temperature and pressure at which combustion is initiated may be varied by selecting the appropriate catalysts. Thus, the present invention facilitates desired control of initiation of the combustion process.

The liquid propellant is preferably introduced into the ignitor as a spray, comprising droplets of HAN/TEAN mixture. The resulting combustion occurs as a result of decomposition of the reactants and is believed to be a combined surface activated gaseous/solid reaction wherein the hydroxyl radicals generated by the HAN come into contact with the TEAN. The action of transition metals is known to disassociate such liquid propellants.

The DC current flowing through the substrate heats the substrate material and thus brings the crystallites of the catalyst on the surface thereof to the activation energy necessary for initiating the combustion reaction of the liquid propellant.

The size and configuration of the ignitor is such that the flow dynamics thereof prevent the combustion reaction, once initiated, from flashing back through the channels of the ignitor. Thus, the ignitor is configured such that the velocity of the liquid propellant spray and heated effluent flowing therethrough is greater than the velocity at which the combustion reaction propagates so as to prevent damage to the catalyst bed during use thereof.

The diameter of the ignitor is particularly dependent upon the particular application. For example, for use with a 155 mm Howitzer, the ignitor is preferably configured so as to accommodate approximately 50 ml of liquid propellant which would be sprayed into the combustion chamber therethrough in order to initiate reaction of the remainder of the liquid propellant as it is forced from the reservoir.

Thus, the ignitor for initiating combustion of liquid propellant of the present invention facilitates the production of a smooth combustion reaction and mitigates the occurrence of undesirable combustion chamber oscillations which commonly occur in contemporary regenerative propellant guns when the liquid propellant from the reservoir begins to enter the combustion process. Additionally, the need for complex and unreliable combustion initiation sequences involving the use of a primer charge, and intermediate charge, and a puddle charge is eliminated.

The ignitor of the present invention may be located in various different positions within or adjacent to the combustion chamber so as to facilitate the introduction of the heated effluent thereinto. For example, the ignitor may be mounted upon a wall of the combustion chamber, or upon the inner piston.

The ignitor of the present invention may additionally be utilized to destroy unused or contaminated liquid propellant by effecting decomposition or combustion thereof. The ignitor may be utilized to ignite a separate larger quantity of liquid propellant or, alternatively may be utilized as a combined ignitor and flame holder by controlling the flow of liquid propellant therethrough.

Such a combined ignitor and flame holder may be utilized in various applications wherein it is desirable to maintain a flame at a given location. For example, U.S. Pat. No. 4,938,112 issued on Jul. 3, 1990 to Hertzberg et al. and entitled APPARATUS AND METHOD FOR THE ACCELERATION OF PROJECTILES TO HYPERVELOCITIES utilizes a flame holder to ignite gaseous propellant in a combustion chamber so as to accelerate a projectile upon which the flame holder is formed.

Those skilled in the art will appreciate that various other uses for such flame holders are likewise possible. Indeed, such a combination of ignitor and flame holder may be used in any application wherein it is desirable to maintain a flame within or proximate a device utilizing the flame. Moreover, the catalytic ignitor of the present invention may find use in various applications other than regenerative propellant guns.

These, as well as other advantages of the present invention will be more apparent from the following description and drawings. It is understood that changes in the specific structure shown and described may be made within the scope of the claims without departing from the spirit of the invention.

DETAILED DESCRIPTION OF THE INVENTION

The detailed description set forth below in connection with the appended drawings is intended as a description of the presently preferred embodiments of the invention, and is not intended to represent the only forms in which the present invention may be constructed or utilized. The description sets forth the functions and sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

The ignitor for initiating combustion of liquid propellant in a regenerative propellant gun according to the present invention is illustrated in FIGS. 1–9 which depict three presently preferred embodiments of the invention.

Figure 1:
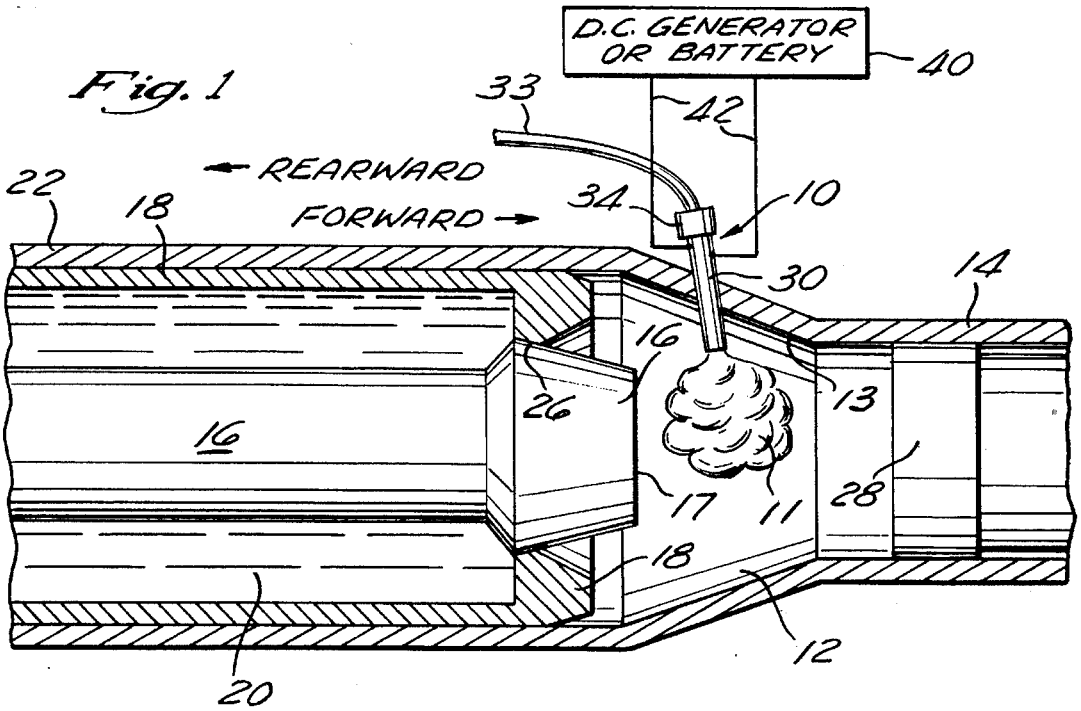
FIG. 1 is a perspective view, partially in cross-section, of a regenerative propellant gun having an ignitor extending into the combustion chamber thereof for initiating combustion of liquid propellant according to the present invention.
Figure 2:
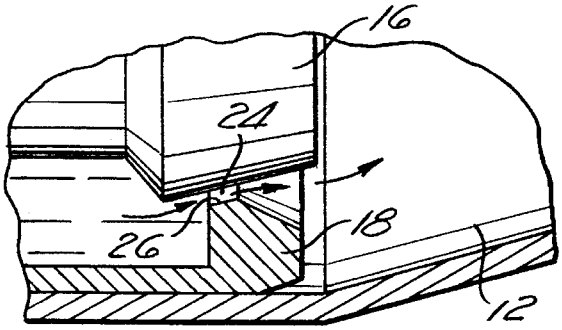
FIG. 2 is an enlarged fragmentary perspective view of the inner and outer pistons of the regenerative propellant gun of FIG. 1.

Referring now to FIGS. 1 and 2, the ignitor 10 extends from a wall 13 of the combustion chamber 12 of a regenerative propellant gun having a barrel 14, an inner piston 16, an outer piston 18, and a reservoir 20 formed intermediate the inner 16 and outer 18 pistons. The inner 16 and outer 18 pistons are formed concentrically such that the inner piston 16 is disposed within and along the longitudinal axis of the outer piston 18. Both the inner 16 and outer 18 pistons are slidably disposed within a cylinder 22 such that they move rearwardly due to the pressures developed during the combustion reaction.

With particular reference to FIG. 2, pressure developed during the combustion reaction drives the inner piston 16, which has a greater surface area, rearward slightly more than it does the outer piston 18, which has a lesser surface area, thus forming an opening 24 at the annular interface 26 of the inner 16 and outer 18 pistons. The reservoir 20 has a stationary rear wall (not shown). Thus, as the inner 16 and outer 18 pistons travel rearward, the volume of the reservoir 20 is reduced and the liquid propellant contained therein is consequently sprayed through the annular orifice 24 into the combustion chamber 12 so as to facilitate regenerative combustion. The pressure developed during the regenerative combustion process urges projectile 28 in the forward direction through the barrel 14.

The ignitor 10 generally comprises a tubular or conical housing 30 containing a catalyst formed upon a heated substrate, as discussed in further detail below. Liquid propellant is provided to the ignitor 10 via liquid propellant conduit 33. An atomizer or sprayhead 34 sprays a fine mist or droplets of a liquid propellant upon the heated catalyst bed of the ignitor 10 so as to initiate combustion of the liquid propellant.

Figure 3:
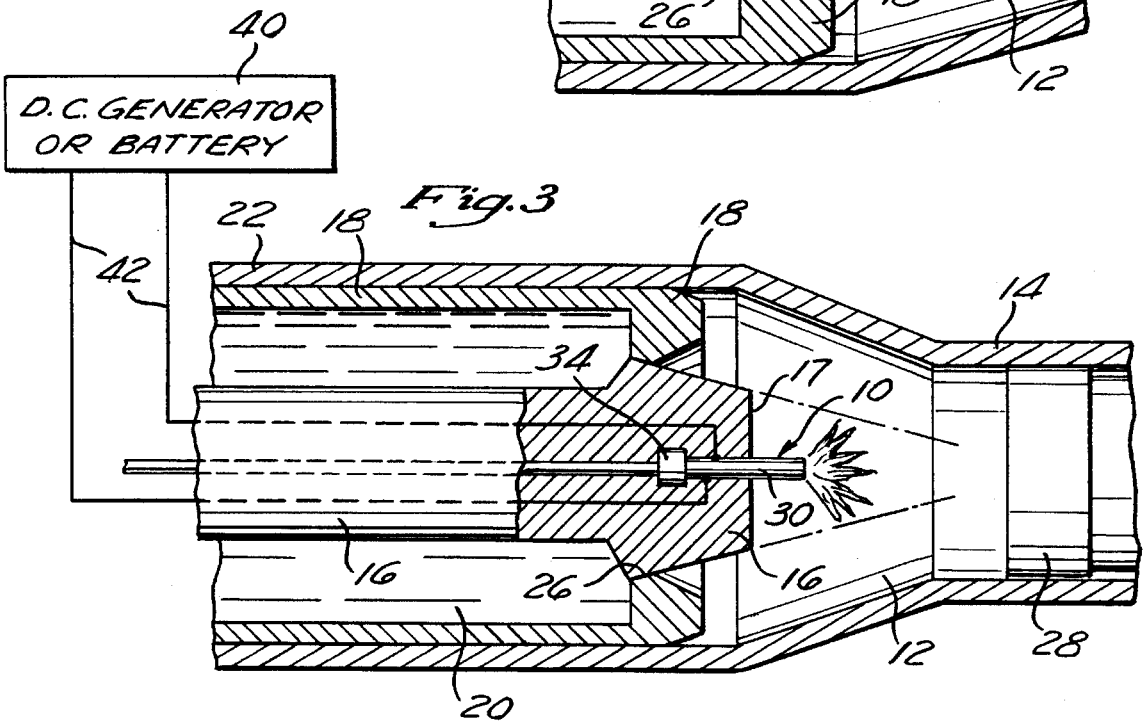
FIG. 3 is a perspective view of a first alternative mounting configuration of the ignitor for initiating combustion of liquid propellant of the present invention wherein the ignitor is mounted upon the inner piston of the regenerative liquid propellant gun.

Referring now to FIG. 3, in a first alternative mounting of the ignitor 10 for initiating combustion of liquid propellant according to the present invention, the ignitor 10 is mounted such that it extends from the forward end 17 of the inner piston 16. The ignitor 10 thus moves rearwardly along with the inner piston 16 and maintains its position relative to the liquid propellant forced from the reservoir 20 as the first 16 and second 18 pistons move rearwardly, thus facilitating a controlled combustion reaction.

Figure 4:
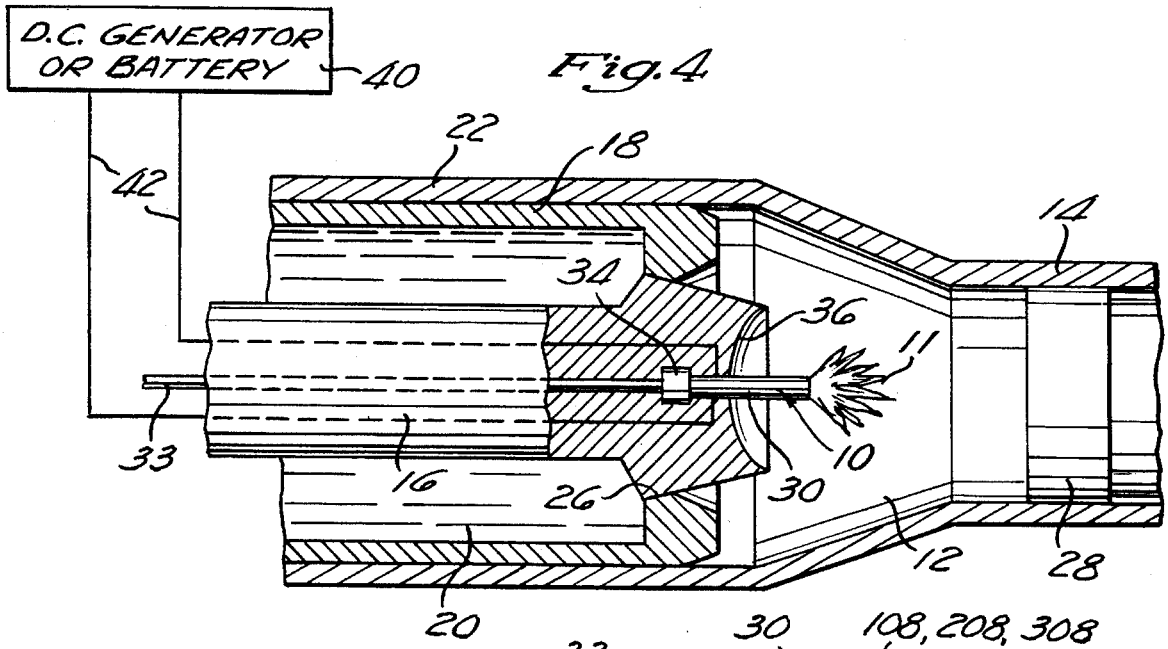
FIG. 4 is a perspective view of a second alternative mounting configuration of the ignitor for initiating combustion of liquid propellant of the present invention wherein the ignitor is mounted upon an inner piston having a concave surface so as to facilitate controlled combustion of the liquid propellant.

Referring now to FIG. 4, in a second alternative mounting of the ignitor 10 for initiating combustion of liquid propellant according to the present invention, the ignitor 10 extends from an inner piston 16 having a concave forward surface 36 so as to provide further control of the combustion reaction. As those skilled in the art will appreciate, the curved surface 36 contains the combustion reaction so as to facilitate combustion of the liquid propellant in a controlled manner.

Figure 5:
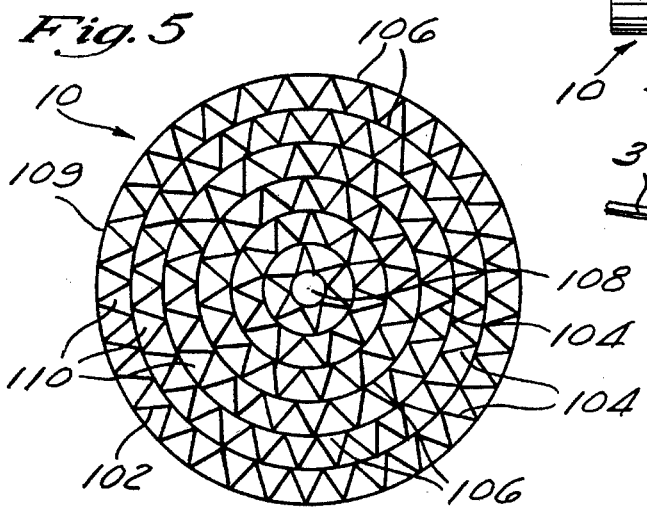
FIG. 5 is a cross-sectional end view of a first embodiment of the catalytic ignitor of the present invention.

Referring now to FIG. 5, a first embodiment of the ignitor 10 more particularly comprises a catalyst formed upon the surface of a substrate. The substrate preferably comprises corrugated material 102 formed in a plurality of concentric tubular layers 104 and separated by non-corrugated layers 106. Both the corrugated layers 104 and non-corrugated layers 106 preferably comprise a substrate having a catalyst formed thereon so as to maximize catalytic surface area. A center or first electrode 108 is formed along the longitudinal axis of the tubular ignitor 10 and the outermost non-corrugated layer 109 forms an outer or second electrode. Thus, a plurality of individual passageways 110 through which liquid propellant is sprayed are defined by the corrugated 102 and non-corrugated 106 substrates.

Figure 6:
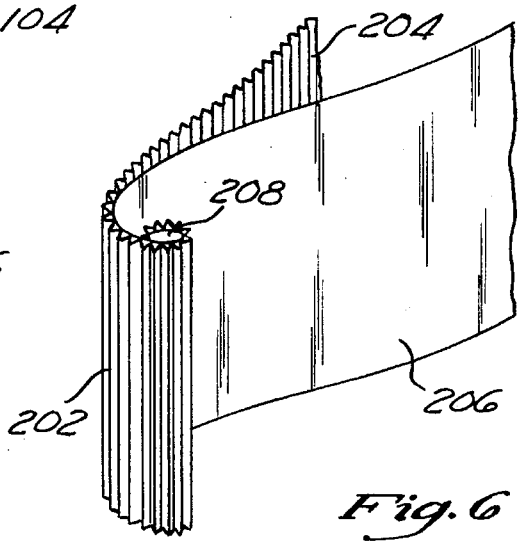
FIG. 6 is a perspective view of a second embodiment of the catalytic ignitor of the present invention wherein the corrugated layer and the separating layer are partially unwound so as to illustrate the construction thereof.

Referring now to FIG. 6, in a second embodiment of the ignitor 10 for initiating combustion of liquid propellant of the present invention, the corrugated substrate 204 is spirally rolled to form a tube. As in the first embodiment of the ignitor, the adjacent layers of corrugated substrate 204 may optionally be separated by a non-corrugated layer of substrate 206. A center electrode 208 facilitates electrical interconnection and an outermost layer of non-corrugated substrate, preferably the tubular housing 30 (FIGS. 1, 3, and 4) of the ignitor 10, forms the second electrode.

Figure 7:
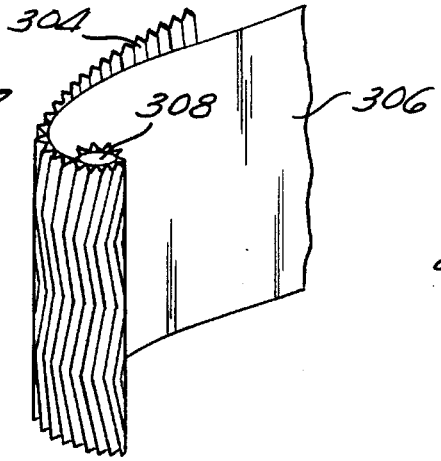
FIG. 7 is a perspective view of a third embodiment of the catalytic ignitor of the present invention wherein the corrugations are formed in a non-linear or chevron configuration.

Referring now to FIG. 7, in a third embodiment of the ignitor 10 for initiating combustion of liquid propellant of the present invention, the corrugated substrate 304 is spirally rolled to form a tube as in the second embodiment of the present invention. However, in the third embodiment of the present invention, the corrugations are non-linear, preferably in the shape of chevrons. Those skilled in the art will recognize that various configurations of the corrugations are likewise suitable. As in the first and second embodiments of the present invention, the adjacent layers of the corrugated substrate 304 may optionally be separated by a non-corrugated layer of substrate 306. A center electrode 308 facilitates electrical interconnection and an outermost layer of the non-corrugated substrate, preferably the tubular housing 30 (FIGS. 1, 3, and 4) of the ignitor 10, forms the second electrode.

Figure 8:
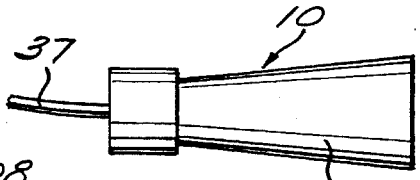
FIG. 8 is a perspective view of an alternative configuration of the catalytic ignitor of the present invention wherein the ignitor has a conical configuration with the inlet at the small end thereof so as to allow for axial expansion of the gaseous products or effluent through the ignitor.

Referring now to FIG. 8, the tubular housing 400 is alternatively formed to have a conical configuration wherein the inlet for sprayhead 34 is disposed at the small end thereof so as to allow for axial expansion of effluent or gaseous products through the ignitor 10. Those skilled in the art will recognize the various other configurations of the tubular housing 30 are likewise suitable.

Figure 9:
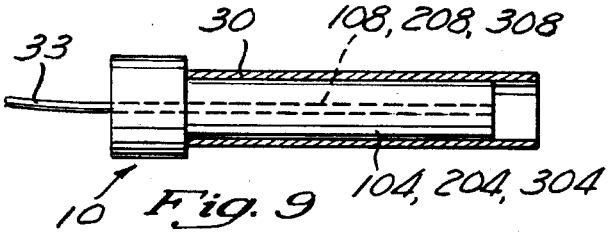
FIG. 9 is a cross-sectional side view of a catalytic ignitor of the first, second, and third embodiments of the present invention.

Referring now to FIG. 9, in the first, second, and third embodiments of the ignitor 10 of the present invention, the first electrode 108, 208, or 308 facilitates electrical connection to a first, preferably the positive terminal of a DC power source and extends axially through the center of the corrugated substrate 104, 204, or 304 which is disposed within the tubular housing 30. The tubular housing 30 forms the second or outer electrode to facilitate electrical connection to the other side, preferably the negative of the DC power source.

In the first, second, and third embodiments of the ignitor 10 for initiating combustion of liquid propellant of the present invention, the substrate preferably comprises a high temperature alloy such as KANTHAL which defines an electric resistance heater such that when a current, preferably DC, is applied at the first 108 or 208 and second 109 or 30 electrodes thereof, the substrate heats to a temperature sufficient to provide the activation energy necessary to initiate combustion of the liquid propellant sprayed thereonto.

In the preferred embodiments of the present invention, the substrate is covered with a wash coat of alumina so as to increase the active surface area of the subsequently applied catalyst. The alumina wash coat is substantially rough and porous as compared to the comparatively smooth surface of the substrate. The catalyst thus impregnates the wash coat.

Further, in each preferred embodiment of the present invention, apertures, e.g., holes, slots, slits, etc., are optionally formed in the corrugated members 104, 204, 304 and/or the non-corrugated members 106, 206, 306 so as to facilitate flow of the effluent laterally between passageways 110.

The catalyst is preferably comprised of a transition metal or alloy, preferably a noble metal such as platinum, palladium, rhodium, iridium, ruthenium, or osmium. Those skilled in the art will recognize that various metals and/or alloys thereof are suitable for use as such a catalyst.

Having thus described the structure of the ignitor for initiating combustion of liquid propellant of the present invention, a brief description of the operation thereof may be useful. The substrate of the ignitor 10, comprising both the corrugated 102 or 202 and the non-corrugated 106 or 206 layers, is heated by allowing current to flow between the first 108 or 208 and second 109 or 30 electrodes. The substrate, as well as the catalyst formed thereon, are heated to a temperature sufficient to provide the activation energy necessary to initiate combustion of liquid propellant sprayed thereonto.

With particular reference to FIGS. 1 and 2, the liquid propellant reservoir contains a desired quantity of liquid propellant and the projectile 28 is positioned within the barrel 14. A quantity of liquid propellant is caused to flow through inlet 33 to the ignitor 10. The atomizer or sprayhead 34 directs a mist or spray of the liquid propellant upon the catalyst formed upon the corrugated 102 or 202 and non-corrugated 106 or 206 substrates whereupon the liquid propellant is ignited. The burning effluent 11 then sprays into the combustion chamber 12.

The resultant pressure within the combustion chamber 12 urges the inner 16 and outer 18 pistons rearward, with the inner piston 16 moving rearward more quickly than the outer piston 18 due to the larger surface area of the inner piston 16. Thus, the annular interface 26 of the inner 16 and outer 18 pistons separates so as to form an annular orifice 24 (as seen in FIG. 2). Rearward motion of the inner 16 and outer 18 pistons forces the liquid propellant from the reservoir 20 and sprays the liquid propellant into the combustion chamber 12 so as to maintain regenerative combustion thereof. The regenerative combustion of the liquid propellant within the combustion chamber 12 urges the projectile 28 from the barrel 24 at high velocity.

With particular reference to FIG. 3, according to the first alternative mounting of the ignitor 10, liquid propellant is sprayed from the reservoir 20 directly onto the ignited liquid propellant effluent 11 from the ignitor 10, so as to provide efficient and controlled combustion thereof.

With particular reference to FIG. 4, according to second alternative mounting of the ignitor 10 for initiating combustion of liquid propellant according to the present invention, the forward wall of the inner piston 16 is formed to have concave surface 36 so as to further contain and control the combustion reaction. As occurs in the first alternative mounting of the ignitor 10, liquid propellant is sprayed from the reservoir 20 directly onto the ignited liquid propellant effluent 11.

It is understood that the exemplary ignitors for initiating combustion of liquid propellant described herein and illustrated in the drawings represent only presently preferred embodiments of the present invention. Indeed, various modifications and additions may be made to such embodiments without departing from the spirit and scope of the invention. For example, the particular configuration of the substrate may comprise structures other than the corrugated and non-corrugated concentric rings or spiral, as described and illustrated. The substrate may comprise a plurality of elongate tubular members positioned together in a bundle, through which the liquid propellant is sprayed. Additionally, various other means of providing electrical interconnection to the substrate to facilitate heating thereof are similarly contemplated. Thus, these and other modifications and additions may be obvious to those skilled in the art and may be implemented to adapt the present invention for use in a variety of different applications.

We claim:

1. A liquid propellant gun for firing a projectile, the gun comprising:

(a) a barrel;

(b) a combustion chamber formed at one end of said barrel such that combustion of liquid propellant therein effects movement of the projectile through said barrel;

(c) a sprayer for spraying liquid propellant into said combustion chamber;

(d) a stationary wall enclosing a portion of said combustion chamber;

(e) an inner piston;

(f) an outer piston substantially surrounding said inner piston; and (g) an ignitor disposed proximate said combustion chamber for initiating combustion of the liquid propellant, said ignitor comprising a catalyst onto which the liquid propellant is sprayed by said sprayer.

2. The gun as recited in claim 1 further comprising a heater for heating said catalyst.

3. The gun as recited in claim 2 wherein said heater comprises an electrical resistance heater.

4. The gun as recited in claim 2 wherein said heater comprises an electrical resistor heater formed of a high temperature alloy.

5. The gun as recited in claim 1 further comprising a substrate upon which said catalyst is formed, said substrate defining a heater for heating said catalyst.

6. The gun as recited in claim 5 wherein said substrate comprises:

(a) a plurality of elongated concentric corrugated members; and (b) a plurality of elongated concentric non-corrugated members separating adjacent corrugated members.

7. The gun as recited in claim 5 wherein said substrate comprises:

(a) a spirally wound layer of corrugated material; and (b) a spirally wound layer of non-corrugated material separating adjacent portions of said corrugated material.

8. The gun as recited in claim 7 wherein said corrugated material comprises non-linear corrugations.

9. The gun as recited in claim 7 wherein said corrugated material comprises corrugations configured as chevrons.

10. The gun as recited in claim 1 wherein said catalyst comprises a metal selected from the group consisting of:

(a) platinum;

(b) palladium;

(c) rhodium;

(d) iridium;

(e) ruthenium; and (f) osmium.

11. The gun as recited in claim 1 wherein said catalyst is formed in a tubular configuration and the liquid propellant flows therethrough.

12. The gun as recited in claim 1 wherein said catalyst is formed in a conical configuration such that the liquid propellant expands as it flows therethrough.

13. The liquid propellant gun as recited in claim 1 wherein the ignitor is disposed upon the stationary wall of the combustion chamber.

14. The liquid propellant gun as recited in claim 1 wherein the ignitor is disposed upon said inner piston.

15. The liquid propellant gun as recited in claim 1 wherein said inner piston comprises a concave surface formed thereupon and the ignitor is disposed upon the concave surface.

16. A method for propelling a projectile from a gun, the method comprising the steps of:

(a) spraying first liquid propellant onto a catalyst disposed proximate a combustion chamber of the gun, the first liquid propellant igniting upon contacting the catalyst to form an effluent; and (b) igniting second liquid propellant sprayed into the combustion chamber with the effluent so as to cause the projectile to move through the barrel of the gun.

17. The method as recited in claim 16 wherein the step of spraying liquid propellant onto the catalyst comprises spraying liquid propellant onto a catalyst comprised of a metal selected from the group consisting of:

(a) platinum;

(b) palladium;

(c) rhodium;

(d) iridium;

(e) ruthenium; and (f) osmium.

18. The method as recited in claim 16 further comprising the step of heating the catalyst to a temperature sufficient to provide an activation energy necessary to initiate combustion of the liquid propellant.

19. The method as recited in claim 18 wherein the step of heating the catalyst comprises heating the catalyst with an electrical resistance heater.

20. The method as recited in claim 18 wherein the step of heating the catalyst comprises heating the catalyst with an electrical resistance heater formed of a high temperature alloy.

* * * * *